US009321980B2

(12) United States Patent
Ricks

(10) Patent No.: US 9,321,980 B2
(45) Date of Patent: Apr. 26, 2016

(54) LUBRICANT AND FUNCTIONAL FLUID ADDITIVE PACKAGE, AND LUBRICANTS AND FUNCTIONAL FLUIDS CONTAINING SAME

(71) Applicant: Materials Engineering and Technical Support Services Corp., Westerville, OH (US)

(72) Inventor: William F. Ricks, Galena, OH (US)

(73) Assignee: Materials Engineering and Technical Support Services Corp., Westerville, OH (US)

( * ) Notice: Subject to any disclaimer, the term of this patent is extended or adjusted under 35 U.S.C. 154(b) by 0 days.

(21) Appl. No.: 13/848,227

(22) Filed: Mar. 21, 2013

(65) Prior Publication Data

US 2013/0217605 A1 Aug. 22, 2013

Related U.S. Application Data

(63) Continuation of application No. 12/924,984, filed on Oct. 8, 2010, now abandoned.

(51) Int. Cl.

| | |
|---|---|
| ***C10M 141/10*** | (2006.01) |
| ***C10M 169/04*** | (2006.01) |
| ***C10M 133/12*** | (2006.01) |

(52) U.S. Cl.

CPC ..... *C10M 141/10* (2013.01); *C10M 169/04* (2013.01); *C10M 2205/0285* (2013.01); *C10M2207/026* (2013.01); *C10M 2207/282* (2013.01); *C10M 2207/288* (2013.01); *C10M 2215/064* (2013.01); *C10M 2215/065* (2013.01); *C10M 2215/182* (2013.01); *C10M 2215/223* (2013.01); *C10M 2223/04* (2013.01); *C10M 2223/041* (2013.01); *C10M 2229/041* (2013.01); *C10N 2220/022* (2013.01); *C10N 2230/06* (2013.01); *C10N 2230/10* (2013.01); *C10N 2240/04* (2013.01); *C10N 2240/08* (2013.01); *C10N 2240/14* (2013.01); *C10N 2240/30* (2013.01)

(58) Field of Classification Search

CPC ..... C10M 141/10; C10M 169/04; C10M 2205/0285; C10M 2207/026; C10M 2207/282; C10M 2207/288; C10M 2215/064; C10M 2215/065; C10M 2215/182; C10M 2215/223; C10M 2223/04; C10M 2223/041; C10M 2229/041; C10N 2240/04; C10N 2240/08; C10N 2240/14; C10N 2240/30

USPC ..... 508/433, 279, 563, 282, 202

See application file for complete search history.

(56) References Cited

U.S. PATENT DOCUMENTS

| | | | | |
|---|---|---|---|---|
| 2006/0128574 | A1 * | 6/2006 | Dong et al. | 508/557 |
| 2007/0004603 | A1 * | 1/2007 | Iyer et al. | 508/441 |
| 2007/0298990 | A1 * | 12/2007 | Carey et al. | 508/591 |
| 2009/0011961 | A1 * | 1/2009 | Dong et al. | 508/149 |

FOREIGN PATENT DOCUMENTS

WO WO 2009134656 A1 * 11/2009

* cited by examiner

*Primary Examiner* — James Goloboy

(74) *Attorney, Agent, or Firm* — Benesch Friedlander Coplan & Aronoff LLP; Benjamen E. Kern; Kraig K. Anderson

(57) ABSTRACT

The present invention is a lubricant or functional fluid additive for a polyolefin oil blend, comprising a mixture of: (a) an anti-wear component consisting essentially of 95% isopropylated triarylphosphate and 5% dodecyl phosphate, the dodecyl phosphate being only partially esterified, the anti-wear component present in the polyolefin oil blend in a range of from about 0.75 percent to about 2.00 percent by weight; (b) an antioxidant component selected from the group consisting of alkylated phenyl-alpha-naphthylamine, phenyl-alpha-naphthylamine and mixtures thereof, and present in the polyolefin oil blend in a range of from about 0.75 percent to about 2.00 percent by weight; (c) an anti-rust component comprising an alkylated succinic acid ester anti-rust agent, and present in the polyolefin oil blend in a range of from about 0.050 percent to about 0.125 percent by weight; and (d) a metal deactivator component comprising a tolytriazole derivative, and present in the polyolefin oil blend in a range of from about 0.050 percent to about 0.125 percent by weight.

11 Claims, 1 Drawing Sheet

LUBRICANT AND FUNCTIONAL FLUID ADDITIVE PACKAGE, AND LUBRICANTS AND FUNCTIONAL FLUIDS CONTAINING SAME

RELATED APPLICATION DATA

This application is a continuation of U.S. application Ser. No. 12/924,984, filed Oct. 8, 2010, which is hereby incorporated herein in its entirety by reference.

FIELD OF THE INVENTION

The present invention relates to lubricant and functional fluids and applications therefor.

BACKGROUND

Lubricants and functional fluids used in submarine propulsion systems must meet challenging operating conditions. Submarines function very independently which means that their operating systems need to perform reliably over long time periods. If a problem occurs with a submarine at sea, the chances for outside assistance are remote. A lubricating fluid in a submarine must therefore be very reliable and due to weight restraints multifunctional.

The current lubricating oil used in submarines (known as 2190-TEP) is a mineral oil based fluid that meets the military specification MIL-PRF-17331. This oil has been used in submarines for the past forty years but the US Navy has increased the severity of the operating conditions in its fleet.

One of the principal objectives of the present invention is to provide lubricating oil that can provide effective lubricity to faster new drive systems that have much higher gear-to-fluid volume interactions, while under higher operating temperatures, which lead to more thermal efficiency. The net result of these more stressful operating conditions is that the existing fluid is failing more quickly leading to high oil replacement and high disposal costs.

The three problems associated with this general objective are (a) high depletion of antioxidants in the mineral oil based fluid, (b) sharp increases in total acid number and (c) severe off-gassing events. Degradation leads to the formation of components such as formaldehyde and carbon monoxide that can be particularly hazardous in the close operating conditions of the submarine.

SUMMARY OF THE INVENTION

The embodiments of the invention described herein addresses the shortcomings of the prior art.

The more rigorous performance conditions demanded by newer ships can be handled by the switch to the lubricating fluids in accordance with the present invention. In addition to submarines, newer surface ships with controllable pitch propeller systems have placed additional demands on the existing 2190-TEP lubricant. The fluids of the present invention may also find advantageous use as hydraulic fluids, air compressor fluids and reducing gear fluids, giving the advantage that a single formulation may be produced, stored and sourced for a variety of uses, especially beneficial while at sea. Accordingly, applications for lubricant or functional fluid additive packages and lubricants and functional fluids of the present invention include lubricating and hydraulic oil, and other functional fluids for motion control, steam turbines and gears in ships and submarines, as submarine air compressor lubricating oil, and in controllable pitch propeller systems in ships and submarines.

In addition, lubricant or functional fluid additive packages and lubricants and functional fluids of the present invention may find additional commercial applications in lubricating environments involving desired low turnover and/or high gear-to-fluid volume interactions, such as may be found, for instance in wind turbine gear systems.

Of particular interest in many military applications are new lubricants or functional fluids that are able to provide both corrosion resistance and lubricating properties. Until now no synthetic lubricant composition has met certain stringent military requirements such as those in U.S. military specification MIL-PRF-17331 for both lubricating and anticorrosive properties.

In addition, fluids of the present invention may be used in the wind turbine industry. Many of the issues faced in submarines are also presented in wind turbines, which must operate over long operating time intervals in remote locations, and with substantial effort and expense associated with lubricant change-over.

The invention includes an additive package, a lubricant or functional fluid including the additive package, and devices containing the lubricant or functional fluid.

Lubricant or Functional Fluid Additive

In general terms, the lubricant or functional fluid additive of the invention may be described as a lubricant or functional fluid additive for a polyolefin oil blend, comprising a mixture of: (a) an anti-wear component consisting essentially of 95% isopropylated triarylphosphate, which has the following general chemical structure:

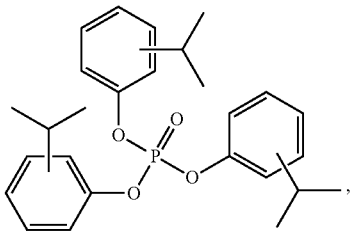

and 5% dodecyl phosphate, which has the following general chemical structure:

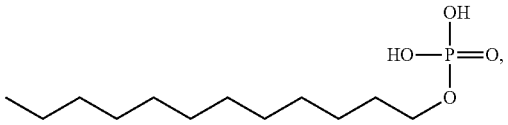

the dodecyl phosphate being only partially esterified, the anti-wear component present in the polyolefin oil blend in a range of from about 0.75 percent to about 2.00 percent by weight; (b) an antioxidant component selected from the group consisting of alkylated phenyl-alpha-naphthylamine ("APAN"), phenyl-alpha-naphthylamine ("PAN") and mixtures thereof, and present in the polyolefin oil blend in a range of from about 0.75 percent to about 2.00 percent by weight; (c) an anti-rust component comprising an alkylated succinic acid ester anti-rust agent, and present in the polyolefin oil blend in a range of from about 0.050 percent to about 0.125 percent by weight; and (d) a metal deactivator component comprising a tolytriazole derivative, which has the following general chemical structure:

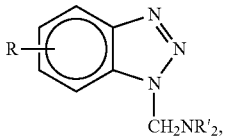

and present in the polyolefin oil blend in a range of from about 0.025 percent to about 0.075 percent by weight.

It is preferred that the antioxidant component is present in the polyolefin oil blend in a range of from about 1.00 percent to about 2.00 percent by weight, and also that the anti-wear component consists essentially of Durad 310M.

It is preferred that the anti-wear component is present in the polyolefin oil blend in a range of from about 1.00 percent to about 2.00 percent by weight, and also that the antioxidant component consists essentially of Naugalube APAN or PAN, which has the following general chemical structure:

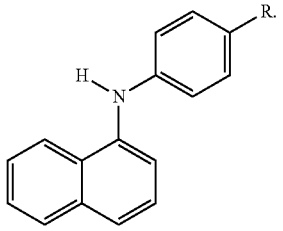

In this same regard, it was found that, where the anti-wear component consists essentially of APAN and/or PAN, or consists only of APAN and/or PAN, the most improved antioxidative performance was achieved.

As to the anti-rust component, it is preferred that the anti-rust component is present in the polyolefin oil blend in a range of from about 0.075 percent to about 0.125 percent by weight, and also that the anti-rust component consists essentially of LZ-859, which has the following general chemical structure:

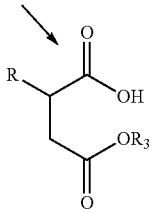

The metal deactivator component is preferably present in the polyolefin oil blend in a range of from about 0.075 percent to about 0.125 percent by weight, and also preferably consists essentially of Irgamet 39.

In the preferred embodiment, the lubricant additive for a polyolefin oil blend, comprising a mixture of: (a) an anti-wear component consisting essentially of 95% isopropylated triarylphosphate and 5% dodecyl phosphate, the dodecyl phosphate being only partially esterified, the anti-wear component present in the polyolefin oil blend in a range of from about 1.00 percent to about 2.00 percent by weight; (b) an antioxidant component selected from the group consisting of alkylated phenyl-alpha-naphthylamine, phenyl-alpha-naphthylamine and mixtures thereof, and present in the polyolefin oil blend in a range of from about 3.00 percent to about 2.00 percent by weight; (c) an anti-rust component comprising an alkylated succinic acid ester anti-rust agent, and present in the polyolefin oil blend in a range of from about 0.095 percent to about 0.100 percent by weight; and (d) a metal deactivator component comprising a tolytriazole derivative, and present in the polyolefin oil blend in a range of from about 0.095 percent to about 0.100 percent by weight.

Lubricant/Functional Fluid Composition

The lubricant/functional fluid composition of the present invention is of a lubricating viscosity and comprises: (a) a polyalphaolefin having a viscosity of about 10 centiStokes at 100° C. and present in the lubricant or functional fluid composition in a range of from about 84 percent to about 88 percent by weight; (b) a polyalphaolefin having a viscosity of about 40 centiStokes at 100° C. and present in the lubricant or functional fluid composition in a range of from about 11 percent to about 13 percent by weight; (c) an anti-wear component consisting essentially of 95% isopropylated triarylphosphate and 5% dodecyl phosphate, the dodecyl phosphate being only partially esterified, the anti-wear component present in the polyolefin oil blend in a range of from about 0.75 percent to about 2.00 percent by weight; (d) an antioxidant component selected from the group consisting of alkylated phenyl-alpha-naphthylamine, phenyl-alpha-naphthylamine and mixtures thereof, and present in the polyolefin oil blend in a range of from about 0.75 percent to about 2.00 percent by weight; (e) an anti-rust component comprising an alkylated succinic acid ester anti-rust agent, and present in the polyolefin oil blend in a range of from about 0.025 percent to about 0.075 percent by weight; and (f) a metal deactivator component comprising a tolytriazole derivative, and present in the polyolefin oil blend in a range of from about 0.025 percent to about 0.075 percent by weight.

Preferably, the polyalphaolefin having a viscosity of about 10 centiStokes at 100° C. is present in the lubricant or functional fluid composition in an amount of about 86 percent by weight; and the polyalphaolefin having a viscosity of about 40 centiStokes at 100° C. is present in the lubricant or functional fluid composition in an amount of about 12 percent by weight.

The preferred parameters of the additive package may be as set forth above.

The lubricant or functional fluid additive and lubricant or functional fluid composition of the present invention optionally may include one or more dyes, such as Unisol Liquid Red BHF, or Silcone Oil (polydimethlysiloxane), such as Dow Corning 200, which has the following general chemical structure:

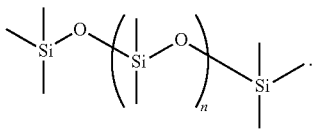

The preferred lubricant/functional fluid composition comprises:

| | |
|---|---|
| PAO 10 | 85.788 |
| PAO 40 | 12.000 |
| Durad 310M | 1.000 |
| Naugalube APAN | 1.000 |

-continued

| | |
|---|---|
| LZ-859 | 0.100 |
| Irgamet 39 | 0.100 |
| Unisol Liquid Red BHF | 0.010 |
| Dow Corning 200 | 0.002 |

As to uses of the present invention, the lubricant or functional fluid or functional fluid may find uses in any application requiring high performance, with the advantages of stable storage and use in environments that may have to accommodate low lubricant or functional fluid turnover. Examples may include marine and submarine use, as well as lubrication and functional fluid applications in wind turbines and the like.

The numerical ranges given herein shall be understood as including all sub-ranges thereof.

DETAILED DESCRIPTION OF THE PREFERRED EMBODIMENTS

Figure 1:
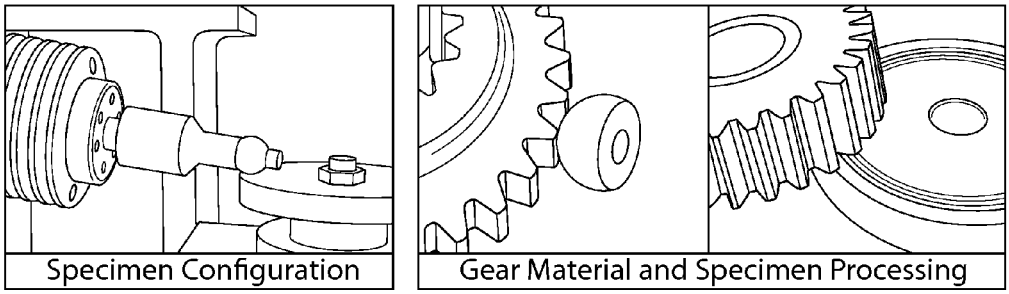
FIG. 1 includes depictions of the apparatus used in a wear test used to validate the results obtained in accordance with one embodiment of the present invention.

In accordance with the foregoing summary, the following describes a preferred embodiment of the present invention which is considered to be the best mode thereof. The invention will now be described in detail with regard for the best mode and preferred embodiment.

The following technical reports describe the development of the antioxidant as well as a brief chronological summary of the 2190-S fluid development.

The research was designed to develop a synthetic alternative to Navy 2190-TEP. A series of synthetic basestocks and mixtures were evaluated, such as polyalphaolefins, alkylated naphthalenes, diesters, polyol esters and polyalkylene glycols, all containing a common commercially available additive package. Lubrizol 857 additive was used, which is recommended at a treat level of 1.4-3.0% in petroleum basestocks to meet the requirements of Navy's MIL-PRF-17331 specification. The research identified 3 candidate fluids that looked promising in most regards, with the exception of rust protection.

Further research focused on improving the rust protection of the candidate formulations. The Lubrizol 857 package was recommended for use at 1.4-3.0%, and was applied initially at a level of 1.5%. Increasing the concentration of the LZ 857 to 3.0-5.0% improved the rust protection, but it was found to be insoluble in the PAO basestock at concentrations above 2.0%. One of the major components of LZ-857 is tricresyl phosphate (TCP) antiwear (AW) additive. Solubility experiments showed that TCP has poor solubility in PAO.

It became apparent that there was still a need to improve the solubility of the antiwear additive in PAO. Chemtura of Middlebury, Conn. manufactures TCP under the trade name Durad 125. The Durad product line includes a number of other alkylated triarylphosphate esters with larger alkyl groups on the triarylphosphate. Durad 300 is an isopropylated triarylphosphate and Durad 620B is a t-butylated triaryphosphate. It was found that substituting the methyl groups on TCP with isopropyl or t-butyl groups greatly improved the PAO solubility of these AW additives.

It was further determined to examine other components of the additive package to see what other attributes of the finished fluid could be improved by reformulation of the additive. The second major component of the Lubrizol 857 additive package is the antioxidant (AO). Most of the AO development effort was conducted over a period of several months. It was during this period that PAN and APAN were identified as the best AO performers and BC-1 as the best finished fluid formulation.

A foaming test indicated that the BC-1 formula required an antifoam (AF) additive to meet the specification requirements, so a polydimethylsoloxane, Dow Corning 200, was added, with the new formula being called BC-1A. BC-1A remained the best candidate for two years until evaluated against the existing 2190-TEP fluid in an FZG gear lubrication test. Although BC-1A met the MIL-PRF-17331 specification gear test requirement, it did not perform as well as 2190-TEP.

It was determined to adjust the formulation again by modifying the Durad AW additive. Durad 310M is a mixture of 95% Durad 300 isopropylated triarylphosphate and 5% dodecyl phosphate. The dodecyl phosphate is only partially esterified, leaving some free acid phosphate present that is inherently more reactive towards active sites on a steel gear surface. The free acid phosphate acts as a trigger to initiate the formation of an iron phosphate lubricating film at the asperity contacts of the rubbing steel surfaces. A test method was needed to optimize the AW characteristics and gear lubrication properties of the formulation.

The US Navy has used the Ryder Gear Test as a means of evaluating aviation gas turbine engine oils. While it has enjoyed a successful history, it also has some drawbacks as a test. A few years ago, the Navy funded Wedeven Associates to develop an alternative test to simulate the speeds, loads and sliding forces experienced by gear teeth. See FIG. 1. The Wedeven Associates Machine (WAM) utilizes a steel ball rotating on a rotating disc, which are driven independently, allowing for full rolling motion, full sliding motion, or anything in between. To demonstrate the invention, 7-8 different formulations prepared with varying concentrations of Durad 620B and Durad 310M. The WAM test results showed a treat level of 1% Durad 310M to provide the most cost effective means of achieving the same AW characteristics and gear lubrication properties as the incumbent 2190-TEP fluid. This formulation is referred to as BC-1A-5 and is the current 2190-S formula.

The preferred lubricant/functional fluid composition comprises:

| | |
|---|---|
| PAO 10 | 85.788 |
| PAO 40 | 12.000 |
| Durad 310M | 1.000 |
| Naugalube APAN | 1.000 |
| LZ-859 | 0.100 |
| Irgamet 39 | 0.100 |
| Unisol Liquid Red BHF | 0.010 |
| Dow Corning 200 | 0.002 |

Antioxidant Evaluation

The effectiveness of various antioxidants in the synthetic fluid was evaluated using differential scanning calorimetry (DSC) in accordance with the ASTM D6186 method to measure the oxidation induction time of the fluid formulations. Initially the formulations were tested under conditions of atmospheric pressure and 200° C. Later the test conditions were modified by decreasing the temperature to 180 and increasing pressure to 500 PSI. An iron catalyst was also added to promote oxidation.

In both sets of tests, formulation BC-7 containing phenylalphanaphthylamine (PAN) and BC-1 containing alkylated phenylalphanaphthylamine (APAN) proved to offer superior oxidation resistance.

TABLE 1

Antioxidant Comparison

| | 2190-TEP | BC-1 | BC-3 | BC-4 | BC-5 | BC-6 | BC-7 |
|---|---|---|---|---|---|---|---|
| PAO-10 (B) | — | 87.8 | 85.8 | 85.8 | 85.8 | 85.8 | 85.8 |
| PAO-40 (C) | — | 10.0 | 12.0 | 12.0 | 12.0 | 12.0 | 12.0 |
| Durad 620B | — | 1.0 | 1.0 | 1.0 | 1.0 | 1.0 | 1.0 |
| LZ-859 | — | 0.1 | 0.1 | 0.1 | 0.1 | 0.1 | 0.1 |
| Irgamet 39 | — | 0.1 | 0.1 | 0.1 | 0.1 | 0.1 | 0.1 |
| Antioxidants | | | | | | | |
| Naugalube APAN | — | 1.0 | — | — | — | — | — |
| Vanlube 81 | — | — | 1.0 | — | — | — | — |
| Naugalube 640 | — | — | — | 1.0 | — | — | — |
| Naugalube 438L | — | — | — | — | 1.0 | — | — |
| Naugalube 531 | — | — | — | — | — | 1.0 | — |
| Ciba L06 | — | — | — | — | — | — | 1.0 |
| Total | — | 100.0 | 100.0 | 100.0 | 100.0 | 100.0 | 100.0 |
| DSC OIT @ 200 C., min. | 22 | 106 | 14 | 9 | 11 | 20 | 78 |
| PDSC OIT @ 180 C., min (With 50 ppm Fe Catalyst) | 15 | 93 | 32 | 40 | 24 | 7 | 115 |

These results demonstrate the unanticipated results obtained with the preferred embodiment of the present invention with respect to the antioxidant performance, as compared to other formulations outside the scope of the present invention.

Lubrication Evaluation

Rapid and fairly economical tribological test methods that may simulate the sliding friction and forces of gear teeth, such as those developed by Wedeven Associates, use a WAM ball-on-disk machine as shown in FIG. 1. Both the ball and disk are made of AISI 9310 steel typically used for gear applications, and are independently driven so their rotational speeds and contact load can be controlled. The test was actually developed with funding from NAVAIR in an effort to develop an alternative to their Ryder Gear Test Method that has been routinely used to evaluate aviation gearbox and gas turbine engine oils. The lubrication characteristics of the 2190-S fluid were optimized through subjecting a series of formulations for WAM Load Capacity testing.

Originally, samples of Navy 2190-TEP and the current 2190-S (labeled BC-1A) were tested, along with two additional formulations BC-1A-2 and BC-1A-3. The formulation designated 2190-S (BC-1A) contained 1% Durad 620B anti-wear additive. BC-1A-2 contained 2% of Durad 620B and BC-1A-3 contained 1.5% Durad 620B and 0.5% Durad 310M. Navy 2190-TEP exhibited a WAM Load Stage Failure of 24, while the BC-1A, BC-1A-2 and BC-1A-3 gave load stage failures of 14, 18 and 23 respectively.

Based on these results, it became clear that the Durad 310M was a much more effective load carrying additive than Durad 620B. In order to optimize the formulation for cost and performance, three more fluids were prepared. BC-1A-4 contained 0.5% each of 620B and 310M, BC-1A-5 contained 1.0% 310M alone, and BC-1A-6 contained 1.0% each of 620B and 310M. These fluids produced load stage failures of 23, 26 and 26 respectively. BC-1A-5 is considered to be the optimum formulation because it provides the highest load capacity at the lowest anti-wear additive treat level. Fluid formulations and corresponding WAM load stage failure loads are listed in Table 2.

Durad 620B and 310M are similar compounds with important differences. Both are alkylated triphenyl phosphates, but the alkyl groups on the 620B are butyl groups, while those on 310M are isopropyl groups. More importantly, the 310M contains 5% of an alkyl acid phosphate, which gives the 310M and acid value of 10-15 mg KOH/g versus an acid value of 0.1 maximum for 620B. The free acid phosphate has a strong affinity for metal surfaces and forms lubricious surface films more readily than the neutral acid phosphate.

TABLE 2

Effect of Antiwear Additive Package on WAM Load Capacity

| Fluid Components | 2190-TEP | BC-1A | BC-1A-2 | BC-1A-3 | BC-1A-4 | BC-1A-5 | BC-1A-6 |
|---|---|---|---|---|---|---|---|
| PAO 10 | | 85.788 | 84.788 | 84.888 | 85.888 | 85.888 | 84.888 |
| PAO 40 | | 12.000 | 12.000 | 12.000 | 12.000 | 12.000 | 12.000 |
| Durad 620B | | 1.000 | 2.000 | 1.500 | 0.500 | | 1.000 |
| Durad 310M | | | | 0.500 | 0.500 | 1.000 | 1.000 |
| APAN | | 1.000 | 1.000 | 1.000 | 1.000 | 1.000 | 1.000 |
| LZ 859 | | 0.100 | 0.100 | 0.050 | 0.050 | 0.050 | 0.050 |
| Irgamet 39 | | 0.100 | 0.100 | 0.050 | 0.050 | 0.050 | 0.050 |
| Unisol Red | | 0.010 | 0.010 | 0.010 | 0.010 | 0.010 | 0.010 |
| DC-200 | | 0.002 | 0.002 | 0.002 | 0.002 | 0.002 | 0.002 |
| TOTAL | 100.000 | 100.000 | 100.000 | 100.000 | 100.000 | 100.000 | 100.000 |
| WAM Load Stage Failure | 24 | 14 | 18 | 23 | 23 | 26 | 26 |

Figure 2:
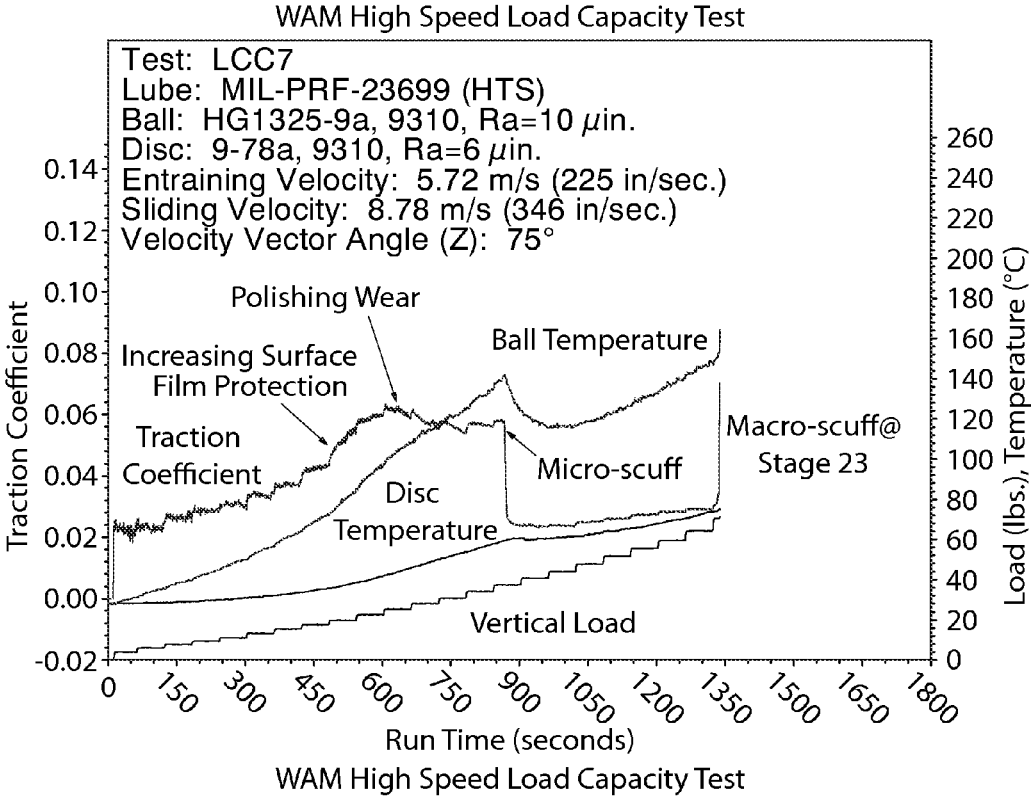
FIG. 2 is a graph of the parameters of the results obtained in a high speed load capacity test, validating the beneficial characteristics obtained in accordance with one embodiment of the present invention.

FIG. 2 is a graph of the parameters of the results obtained in a high speed load capacity test, validating the beneficial characteristics obtained in accordance with one embodiment of the present invention.

These results further demonstrate the unanticipated results obtained with the preferred embodiment of the present invention with respect to the further anti-wear package performance, in addition to the results obtained with respect to the antioxidant performance described above as compared to other formulations outside the scope of the present invention.

The instant invention is shown and described herein in what is considered to be the most practical and preferred embodiments. It is recognized, however, that departures may be made therefrom which are within the scope of the invention, and that obvious modifications will occur to one skilled in the art upon reading this disclosure.

What is claimed is:

1. A lubricant or functional fluid composition of a lubricating viscosity and comprising:

(a) a polyalphaolefin having a viscosity of about 10 centiStokes at 100° C. and present in said lubricant or functional fluid composition in a range of from about 84 percent to about 88 percent by weight;

(b) a polyalphaolefin having a viscosity of about 40 centiStokes at 100° C. and present in said lubricant or functional fluid composition in a range of from about 11 percent to about 13 percent by weight;

(c) an anti-wear component consisting essentially of 95% isopropylated triarylphosphate and 5% dodecyl phosphate, said dodecyl phosphate being only partially esterified, said anti-wear component present in said polyolefin oil blend in a range of from about 1.00 percent to about 2.00 percent by weight, said anti-wear component being characterized by an acid value from about 10 mg KOH/g to about 15 mg KOH/g;

(d) an antioxidant component selected from the group consisting of alkylated phenyl-alpha-naphthylamine, phenyl-alpha-naphthylamine and mixtures thereof, and present in said polyolefin oil blend in a range of from about 0.75 percent to about 2.00 percent by weight;

(e) an anti-rust component comprising an alkenyl succinic acid ester anti-rust agent, and present in said polyolefin oil blend in a range of from about 0.025 percent to about 0.075 percent by weight; and (f) a metal deactivator component comprising a tolytriazole derivative, and present in said polyolefin oil blend in a range of from about 0.025 percent to about 0.075 percent by weight.

2. The lubricant or functional fluid composition of claim 1, wherein said polyalphaolefin having a viscosity of about 10 centiStokes at 100° C. is present in said lubricant or functional fluid composition in an amount of about 86 percent by weight; and wherein said polyalphaolefin having a viscosity of about 40 centiStokes at 100° C. is present in said lubricant or functional fluid composition in an amount of about 12 percent by weight.

3. The lubricant or functional fluid composition of claim 1, wherein said antioxidant component is present in said polyolefin oil blend in a range of from about 1.00 percent to about 2.00 percent by weight.

4. The lubricant or functional fluid composition of claim 3, wherein said antioxidant component consists essentially of the alkylated phenyl-alpha-naphthylamine.

5. The lubricant or functional fluid composition of claim 1, wherein said anti-rust component is present in said polyolefin oil blend in a range of from about 0.045 percent to about 0.055 percent by weight.

6. The lubricant or functional fluid composition of claim 5, wherein said anti-rust component consists essentially of the alkenyl succinic acid ester anti-rust agent.

7. The lubricant or functional fluid composition of claim 1, wherein said metal deactivator component is present in said polyolefin oil blend in a range of from about 0.045 percent to about 0.055 percent by weight.

8. The lubricant or functional fluid composition of claim 7, wherein said anti-rust component consists essentially of the tolytriazole derivative.

9. A lubricant or functional fluid composition of a lubricating viscosity, comprising:

a polyalphaolefin having a viscosity of about 10 centiStokes at 100° C. and present in the lubricant or functional fluid composition in an amount of 85.8 percent by weight;

a polyalphaolefin having a viscosity of about 40 centiStokes at 100° C. and present in the lubricant or functional fluid composition in an amount of 12 percent by weight;

an anti-wear component consisting essentially of 95% isopropylated triarylphosphate and 5% dodecyl phosphate, the dodecyl phosphate being only partially esterified, the anti-wear component present in the polyolefin oil blend in an amount of 1 percent by weight, the anti-wear component characterized by an acid value from about 10 mg KOH/g to about 15 mg KOH/g;

an antioxidant component selected from the group consisting of alkylated phenyl-alpha-naphthylamine, phenyl-alpha-naphthylamine and mixtures thereof, the antioxidant being present in the polyolefin oil blend in an amount of 1 percent by weight;

an anti-rust component comprising an alkenyl succinic acid ester anti-rust agent, the anti-rust component being present in the polyolefin oil blend in an amount of about 0.1 percent by weight;

a metal deactivator component comprising a tolytriazole derivative, the metal deactivator component being present in the polyolefin oil blend in an amount of 0.1 percent by weight;

a dye present in the polyolefin oil blend in an amount of 0.01 percent by weight; and a polydimethlysiloxane present in the polyolefin oil blend in an amount of 0.002 percent by weight, the lubricant or functional fluid composition being characterized by a Wedeven Associates Machine (WAM) load stage failure test rating of about the same or greater compared to a WAM load stage failure test rating of 2190-TEP under the same test conditions.

10. The lubricant or functional fluid composition of claim 1, characterized by a Wedeven Associates Machine (WAM) load stage failure test rating of about the same or greater compared to a WAM load stage failure test rating of 2190-TEP under the same test conditions.

11. A lubricant or functional fluid composition of a lubricating viscosity and comprising:

a polyolefin oil blend, comprising: a polyalphaolefin having a viscosity of about 10 centiStokes at 100° C. and present in the lubricant or functional fluid composition in a range of from about 84 percent to about 88 percent by weight; and a polyalphaolefin having a viscosity of about 40 centiStokes at 100° C. and present in the lubricant or functional fluid composition in a range of from about 11 percent to about 13 percent by weight;

an anti-wear component consisting essentially of 95% isopropylated triarylphosphate and 5% dodecyl phosphate, the dodecyl phosphate being only partially esterified, the anti-wear component being present in the polyolefin oil blend in a range of from about 1 percent by weight to about 2 percent by weight, the anti-wear component being characterized by an acid value of from about 10 mg KOH/g to about 15 mg KOH/g;

an antioxidant component selected from the group consisting of alkylated phenyl-alpha-naphthylamine, phenyl-alpha-naphthylamine and mixtures thereof, the antioxidant component being present in the polyolefin oil blend in a range of from about 0.75 percent by weight to about 2 percent by weight;

an anti-rust component comprising an alkenyl succinic acid ester anti-rust agent, the anti-rust component being present in the polyolefin oil blend in a range of from about 0.05 percent by weight to about 0.125 percent by weight; and a metal deactivator component comprising a tolytriazole derivative, the metal deactivator component being present in the polyolefin oil blend in a range of from about 0.025 percent by weight to about 0.125 percent by weight.

* * * * *

UNITED STATES PATENT AND TRADEMARK OFFICE

CERTIFICATE OF CORRECTION

PATENT NO. : 9,321,980 B2
APPLICATION NO. : 13/848227
DATED : April 26, 2016
INVENTOR(S) : William F. Ricks et al.

It is certified that error appears in the above-identified patent and that said Letters Patent is hereby corrected as shown below:

IN THE SPECIFICATION

Column 1 Line 11 Insert

--Government Support
This invention was made with government support under SBIR Contract No. N00024-05-C-4169, awarded by the Department of Defense. The government has certain rights in the invention.--

Signed and Sealed this
Twenty-eighth Day of June, 2016

Michelle K. Lee

Michelle K. Lee
*Director of the United States Patent and Trademark Office*